US006383090B1

(12) United States Patent
O'Doherty et al.

(10) Patent No.: US 6,383,090 B1
(45) Date of Patent: May 7, 2002

(54) GOLF CLUBS

(76) Inventors: J. Bryan O'Doherty, 270 SW. Birdshill Rd., Portland, OR (US) 97219; Guy Mount, III, 67367 Three Creeks Rd., Sisters, OR (US) 97759

( * ) Notice: Subject to any disclaimer, the term of this patent is extended or adjusted under 35 U.S.C. 154(b) by 0 days.

(21) Appl. No.: 09/560,431

(22) Filed: Apr. 28, 2000

(51) Int. Cl.[7] ..... A63B 53/04
(52) U.S. Cl. ..... 473/329; 473/342; 473/345
(58) Field of Search ..... 473/324, 329, 473/332, 345, 346, 305, 349, 350, 342

(56) References Cited

U.S. PATENT DOCUMENTS 632,885 A 9/1899 Sweny
1,571,109 A 1/1926 East
5,083,778 A 1/1992 Douglas
5,106,094 A * 4/1992 Desbiolles
5,154,424 A 10/1992 Lo
5,255,918 A 10/1993 Anderson
5,299,807 A 4/1994 Hutin
5,333,861 A 8/1994 Mills
5,415,398 A 5/1995 Eggiman
5,431,396 A 7/1995 Shieh
5,467,983 A 11/1995 Chen
5,499,814 A 3/1996 Lu
5,524,331 A 6/1996 Pond
5,718,641 A * 2/1998 Lin
5,743,813 A * 4/1998 Chen
5,766,095 A * 6/1998 Antonious
5,863,261 A 1/1999 Eggiman
5,888,148 A * 3/1999 Allen
5,993,331 A * 11/1999 Shieh
6,165,081 A * 12/2000 Chou

* cited by examiner

*Primary Examiner*—Sebastiano Passaniti
(74) *Attorney, Agent, or Firm*—Robert L. Harrington

(57) ABSTRACT

A golf club that has a reinforcement wall within the body of the club in close proximity behind the striking face.

6 Claims, 1 Drawing Sheet

GOLF CLUBS

FIELD OF THE INVENTION

This invention relates to the construction of a golf club and more particularly to the inclusion in a hollow golf club head of a reinforcement or secondary wall.

BACKGROUND OF THE INVENTION

Golf clubs (other than the putter) are typically referred to as irons and woods. The difference (other than shaft length) is in the heads which are designed to strike a golf ball. The irons are configured as a metal (steel) blade and are used for accuracy and shorter distances as compared to woods. The heads of the woods are somewhat elliptically shaped (ellipsoid) but having a flat front striking face. Whereas woods were originally made of wood material, more recently they have been made of metal and are referred to as metal woods. This invention is directed to metal woods.

A metal wood, like its wood material predecessor, is somewhat elliptically shaped (ellipsoid). However, rather than being solid, it is hollow. An objective is to provide an appropriate balance of weight as between the shaft and the head. A further objective is to provide a desired weight distribution within the head design. A larger head requires a lighter material and vice versa. Typically the striking face is a non-soft (hard) metal to cause the ball to rebound off the face with the least amount of velocity loss. The shell of the head (extended rearwardly from the striking face) may be softer metal or simply a thinner section of the same metal to make it lighter as desired to produce weight distribution but of course maintaining a required level of structural integrity.

Within the constraints as generally described above, it is desired by the club manufacturer to produce a club head that will produce the minimum velocity loss and thus maximum distance when striking a golf ball. The present invention is directed to this objective.

BRIEF DESCRIPTION OF THE INVENTION

The present invention provides a secondary or reinforcement wall provided in a spaced relation behind the striking face of the club head. Through experimentation it has been determined that the provision of such a secondary wall does indeed provide less loss in rebounding velocity. It has been further determined that placing the secondary wall close to the striking face but maintaining a space from the striking face, further improves the velocity loss. Manufacturing limitations dictate an optimum distance of about 6 millimeters (mm.) although distances as small as 3 mm. or even smaller are believed to produce the desired results. A spacing up to about half the distance of the club head length will produce some benefit in reduced rebounding velocity loss.

Whereas the experiments performed, involving numerous structural arrangements, have emphatically established a benefit from the use of the secondary wall, the physical properties that produce the benefits are not totally understood. The following explanation is derived from the vast array of test results but is nevertheless theoretical.

The use of a hard metal face is considered important to avoid impact absorption. Maraging Steel, a hard metal material, is considered a type of metal that is desirable as the face material. Maraging Steel is understood to have a hardness of about 47 HRC. Other acceptable metals are however available. The selection of an acceptable metal may be determined based on hardness and/or thickness such as to provide satisfactory elasticity while avoiding undesired brittleness. It also preferably has minimal plasticity which is considered to be a detrimental property of energy absorption.

Maintaining the relative properties of high elasticity/low plasticity for the striking face is an objective for achieving the desired performance. However, encasing that striking face in a thin metal shell tends to defeat this objective. The thin metal shell is considered desirable, e.g., for balancing weight. However, what is believed to happen is that the face itself transfers the impact to the shell where impact absorption occurs. The placement of the secondary wall is believed to provide a re-enforcing effect that largely restricts the transfer of the impact to the surrounding shell. The greater the distance between the two walls, the greater the undesired absorption. Retaining a short distance between the walls retains the rebounding affect of the face material. As previously indicated, a 6 mm. distance is optimum considering manufacturing limitations, e.g., for placement of the hosel and for securing the sole or ground plate and the striking face to the shell (e.g., by welding, brazing, etc.). Benefits are achieved, however, with as great as 50% of the length of the head and as close as 3 mm. or even less from the face plate.

The invention will be more fully understood upon reference to the following detailed description of the preferred embodiment having reference to the accompanying drawings referred to therein.

DESCRIPTION OF THE PREFERRED EMBODIMENT

Figure 1:
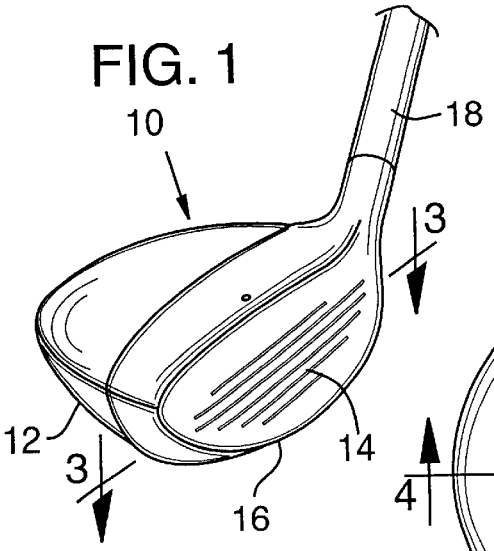
FIG. 1 is a view of a golf club of the present invention.
Figure 2:
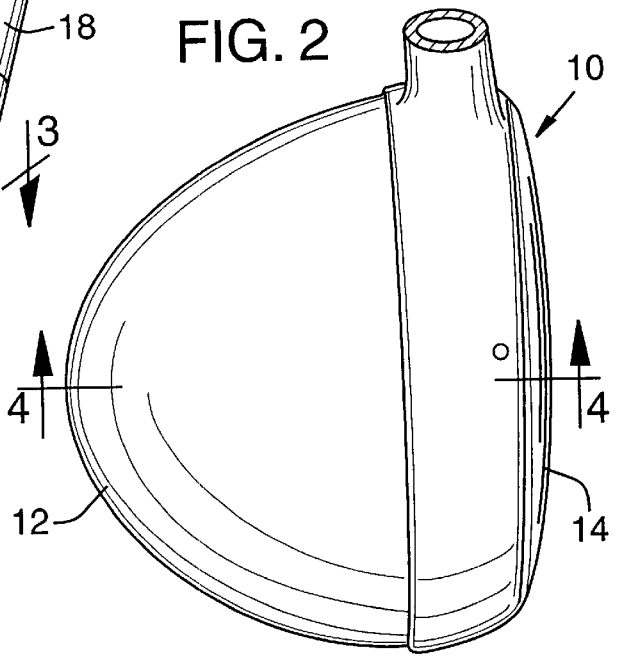
FIG. 2 is a top view of the club head of the golf club of FIG. 1.

Refer now to FIG. 1 of the drawings which illustrates a golf club including a club head 10 and a shaft 18. The club head 10 is configured to provide a striking force on a golf ball that imparts a greater discharge velocity than other club heads of the same configuration. The club head 10 is of metal construction rather a than wood and has interior structure that enhances the discharge velocity of a golf ball when hit by the club head 10.

The club head 10 is of metal construction and has a body 12 (an ellipsoid-like configured body) that is essentially hollow. The club head 10 has a striking face 14 and a sole plate 16 (the under side of the club head). The shaft 18 is fitted to a hosel 19 which is extended from the body 12 to facilitate hitting a golf ball by a golfer.

Figure 3:
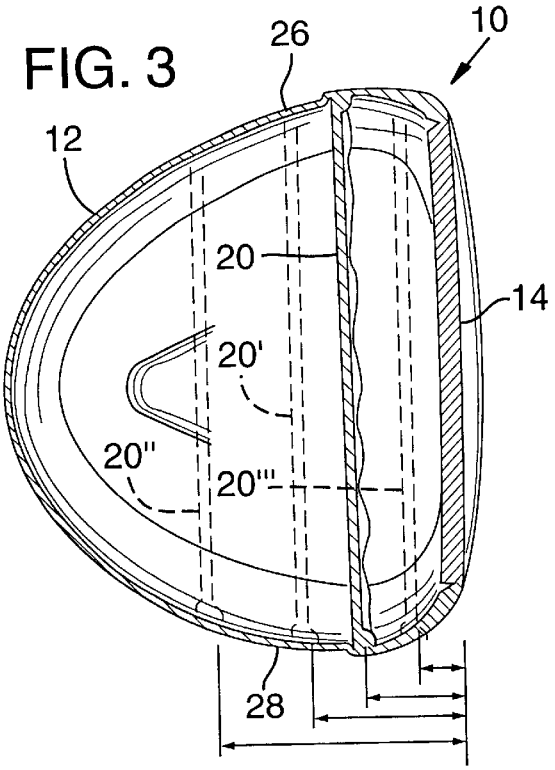
FIG. 3 is a view as viewed on view lines 3—3 of FIG. 1.
Figure 4:
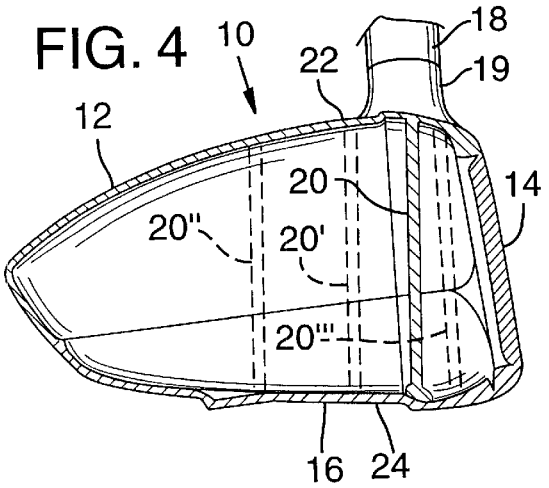
FIG. 4 is a view as viewed on view lines 4—4 of FIG. 2.

Refer now to FIGS. 3 and 4 of the drawings which further illustrate the structure of the body 12 of the club head 10. As shown in the figures, a secondary substantially vertical wall 20 extends across the body 12 of the club 10 and is in close proximity to the striking face 14. The wall 20 is configured to fit the inside surface of the body cavity. The entire periphery of the wall 20 is fixedly attached either by welding or integrally casting the wall with the body 12. The wall is attached to the upper section 22, the lower section 24 and the sides 26 and 28 of the body 12.

From tests conducted on various configurations it has been found that the wall 20 provides the most beneficial results when it is mounted in close proximity to the striking face 14 of the club head body 12. As by way of example, alternative mounting positions of the wall are shown in the figures and are designated as wall 20', wall 20" and wall 20'". While the secondary walls 20' and 20" have shown to provide increased discharge velocities, the wall 20 in close proximity to the striking face 14 produces the most beneficial results. The position of wall 20" is considered to provide a minimum of benefit (at about 50% of the length of the cavity within the body). 9 mm. or less spacing from face 14 is considered preferable. 6 mm. is considered optimum for combined manufacturing and performance considerations whereas the closer spacing of 22'" is believed to provide equal or better performance. Whereas a rear vertical wall, substantially parallel to the face 14 is desired, the beneficial results will be achieved with the wall 20 somewhat angled in any direction. Such angling of wall 20 is considered substantially vertical.

It is believed that the secondary wall 20 being fixedly attached to the body 12 and in close proximity to the striking face 14 provides a structural benefit that reduces the deflection of the striking face 14 when it strikes a golf ball (thereby increasing distance). The wall 20 being connected to the upper and lower sections 22, 24 reduces the flexure of the sections 22, 24 when the striking face 14 impacts a golf ball. That is, the flexure is confined to that portion of the sections between face 14 and wall 20. Similarly the wall 20 being connected to the sides 26, 28 of the body 12 reduces the flexure of the sides 26, 28 of the body 12. The reduced flexure of the sections 22, 24 and the sides 26, 28 accordingly provides a more rigid non-yielding support for the striking face 14 when it impacts a golf ball.

In this preferred embodiment the body 12 of the club 10 including sections 22 and sides 26 and 28 is produced by casting. The striking face 14 (which is preferable but not necessarily of a harder, less plastic material such as Maraging Steel) and the sole plate 16 (including section 24) are attached to the body 12 as by welding. The striking face 14 can thus be constructed of a different material than that of the body 12. The body may have less plasticity and deflection characteristics, e.g., due to the different hardness but also, or instead of by the reduced thickness as compared to face 14.

Those skilled in the art will recognize that modifications and variations may be made without departing from the true spirit and scope of the invention. The invention is therefore not to be limited to the embodiments described and illustrated but is to be determined from the appended claims.

What is claimed is:

1. A metal wood golf club comprising:

a metal head having a front substantially vertical striking face wall and an ellipsoid configured body defining an inner cavity defining a cavity length, said face wall secured to said ellipsoid body, said face wall produced from a hard metal selected to minimize or avoid flexing of the metal of said face wall when impacting a golf ball and thereby to minimize velocity loss that occurs in rebounding of a golf ball from the face wall;

a substantially vertical second wall inset from said face wall and secured substantially at its entire periphery to said ellipsoid body at a position rearward of said face wall and said second wall, said second wall spaced no greater from said face wall than half the length of said cavity; and said face wall, said second wall and said body wall portion cooperatively structured to define an enclosed and empty sub-cavity whereby transfer of ball impact to the second wall occurs only through the interconnecting body wall portion.

2. A metal wood golf club as defined in claim 1 wherein the second wall is spaced from said face wall no greater than about 9 mm.

3. A metal wood golf club as defined in claim 1 wherein the second wall is spaced from said face wall about 6 mm.

4. A metal wood golf club comprising:

a metal head having a substantially vertical striking face wall of hard metal selected to minimize or avoid flexing when impacted by a golf ball, an ellipsoid body of metal and defining an inner cavity having a cross sectional reinforcing wall having a periphery matching the configuration of the inner cavity at a position spaced close to and inwardly of said striking face wall but maintaining a space from the striking face wall, said reinforcing wall secured continuously at its periphery to the inside surface of the body and thereby confining absorption of impact on the striking face to that portion of the body between the reinforcing wall and striking face said striking face wall, said reinforcing wall and said portion of the body defining an empty sub-cavity whereby transfer of ball impact to the reinforcing wall occurs only through said portion of the body.

5. A metal wood golf club as defined in claim 4 wherein the body top and sides and the reinforcing wall are integrally formed in a molding operation.

6. A metal wood golf club as defined in claim 4 wherein a hosel for supporting a shaft is secured to the body at a position substantially between the striking face and reinforcing wall.

* * * * *

UNITED STATES PATENT AND TRADEMARK OFFICE

CERTIFICATE OF CORRECTION

PATENT NO. : 6,383,090 B1
DATED : May 7, 2002
INVENTOR(S) : O'Doherty et al.

It is certified that error appears in the above-identified patent and that said Letters Patent is hereby corrected as shown below:

Column 4,
Line 30, before "reinforcing" insert -- configuration defined by an inside surface of the body, an inset --

Signed and Sealed this

Twenty-fourth Day of September, 2002

*Attest:*

*Attesting Officer*

JAMES E. ROGAN
*Director of the United States Patent and Trademark Office*